US010669093B2

(12) United States Patent
Empl et al.

(10) Patent No.: US 10,669,093 B2
(45) **Date of Patent: *Jun. 2, 2020**

(54) SINGLE SERVE CAPSULE COMPRISING A FILTER ELEMENT CONNECTED THERETO BY SEALING

(71) Applicant: K-FEE SYSTEM GMBH, Bergisch Gladbach (DE)

(72) Inventors: Günter Empl, Bergisch Gladbach (DE); Andre Throm, Köln (DE); Marco Hanisch, Overath (DE)

(73) Assignee: K-FEE SYSTEM GMBH, Bergisch Gladbach (DE)

( * ) Notice: Subject to any disclaimer, the term of this patent is extended or adjusted under 35 U.S.C. 154(b) by 5 days.

This patent is subject to a terminal disclaimer.

(21) Appl. No.: 15/553,636

(22) PCT Filed: Feb. 22, 2016

(86) PCT No.: PCT/EP2016/053684
§ 371 (c)(1),
(2) Date: Aug. 25, 2017

(87) PCT Pub. No.: WO2016/135105
PCT Pub. Date: Sep. 1, 2016

(65) Prior Publication Data

US 2018/0029790 A1 Feb. 1, 2018

(30) Foreign Application Priority Data

Feb. 27, 2015 (DE) ..... 10 2015 203 585

(51) Int. Cl.
*B65D 85/804* (2006.01)
*B65D 77/24* (2006.01)

(52) U.S. Cl.
CPC ..... *B65D 85/8043* (2013.01); *B65D 77/24* (2013.01)

(58) Field of Classification Search
CPC ..... B65D 85/8043; B65D 77/24
See application file for complete search history.

(56) References Cited

U.S. PATENT DOCUMENTS

| | | | |
|---|---|---|---|
| 923,706 | A | 1/1909 | Richey et al. |
| 1,051,426 | A | 2/1911 | Matheson |
| 1,036,589 | A | 11/1911 | Eggleston |

(Continued)

FOREIGN PATENT DOCUMENTS

| | | | |
|---|---|---|---|
| AU | 2014203212 | A1 | 7/2014 |
| CA | 2436389 | A1 | 8/2002 |

(Continued)

OTHER PUBLICATIONS

Rawle, Alan, "Particle Sizing—An Introduction" 2012; Silver Colloids, Edition or volume on Colloidal Silver.

(Continued)

*Primary Examiner* — Viren A Thakur
*Assistant Examiner* — Chaim A Smith
(74) *Attorney, Agent, or Firm* — The Dobrusin Law Firm, P.C.

(57) ABSTRACT

The present invention relates to a single serve capsule for preparing a beverage, comprising a side wall and a bottom, which together define a space, a filter element being sealed to the bottom within said space.

14 Claims, 2 Drawing Sheets

(56) References Cited

U.S. PATENT DOCUMENTS 1,329,461 A 2/1920 Frantz
1,485,200 A 2/1924 Roberts et al.
1,689,665 A 10/1928 Cramp
2,732,919 A 1/1956 Johnson
2,778,739 A 1/1957 Rodth
2,847,726 A 8/1958 Frick
3,039,153 A 6/1962 Dusing
3,183,096 A 5/1965 Hiscock
3,261,129 A 7/1966 Brydolf et al.
3,327,428 A 6/1967 Horton et al.
3,363,588 A 1/1968 Harrington et al.
3,416,183 A 12/1968 Martin
3,473,266 A 10/1969 Miller
3,480,989 A 12/1969 Edeus
3,611,637 A 10/1971 Saino
3,631,793 A 1/1972 Bednartz
3,640,727 A 2/1972 Heusinkveld
4,081,880 A 4/1978 Edeas
4,325,204 A 4/1982 Martine
4,404,770 A 9/1983 Markus
4,424,605 A 1/1984 Squires et al.
4,452,014 A 6/1984 Markus
4,488,387 A 12/1984 Foti
4,513,535 A 4/1985 Uphoff
4,534,985 A 8/1985 Gasau
4,540,595 A 9/1985 Acitelli et al.
4,633,614 A 1/1987 Van Weelden
4,651,469 A 3/1987 Ngian et al.
4,644,151 A 5/1987 Piet
4,676,482 A 6/1987 Reece
4,680,828 A 7/1987 Cook et al.
4,742,645 A 5/1988 Johnston
4,859,337 A 8/1989 Woltermann
4,860,645 A 8/1989 Van Der Lijn et al.
4,867,993 A 9/1989 Nordskog
4,881,346 A 11/1989 Block
4,936,049 A 6/1990 Hansen
4,976,179 A 12/1990 Lacrouts-Cazenave
4,995,310 A * 2/1991 van der Lijn ..... B65D 85/8043 210/282
5,012,629 A 5/1991 Rehman et al.
5,028,769 A 7/1991 Claypool et al.
5,079,872 A 1/1992 Short
5,108,768 A 4/1992 So
5,242,702 A 9/1993 Fond
5,243,164 A 9/1993 Erickson et al.
5,251,758 A 10/1993 Kolacek
5,285,041 A 2/1994 Wright
5,301,468 A 4/1994 Kameaki
5,325,765 A 7/1994 Sylvan et al.
5,351,442 A 10/1994 Gingras
5,450,693 A 9/1995 Tarrega
5,460,078 A 10/1995 Weller
5,461,829 A 10/1995 Lehto et al.
5,496,573 A 3/1996 Tsuji et al.
5,501,945 A 3/1996 Kanakkanatt
5,535,765 A 7/1996 Takashima
5,566,505 A 10/1996 Kameaki
5,601,716 A 2/1997 Heinrich et al.
5,637,850 A 6/1997 Honda
5,638,740 A 6/1997 Cai
5,656,311 A 8/1997 Fond
5,672,368 A 9/1997 Perkins
5,677,522 A 10/1997 Rice et al.
5,725,261 A 3/1998 Rahn
5,742,979 A 4/1998 Garcia-Hernando
5,840,189 A 11/1998 Sylvan et al.
5,888,549 A 3/1999 Buchholz et al.
5,895,672 A 4/1999 Cooper
5,917,165 A 6/1999 Platt et al.
5,941,055 A 8/1999 Coates
5,948,455 A 9/1999 Schaeffer et al.
5,980,743 A 11/1999 Bairischer
5,994,677 A 11/1999 Akerlind
6,082,499 A 7/2000 O'Donnell
6,153,026 A 11/2000 Michotte
6,199,780 B1 3/2001 Görlitz
6,250,016 B1 6/2001 Gravel
6,289,643 B1 9/2001 Bonar
6,299,926 B1 10/2001 Balakrishnan et al.
6,440,256 B1 8/2002 Gordon et al.
6,451,332 B1 9/2002 Tanaka et al.
6,589,577 B2 7/2003 Lazaris et al.
6,598,800 B1 7/2003 Schmit et al.
6,607,762 B2 8/2003 Lazaris et al.
6,627,244 B2 9/2003 Omura
6,645,537 B2 11/2003 Sweeney et al.
6,655,260 B2 12/2003 Lazaris
6,861,086 B2 3/2005 Buckingham et al.
6,871,448 B1 3/2005 Kline
6,948,420 B2 9/2005 Kirschner et al.
6,994,879 B2 2/2006 Cirigliano et al.
7,408,094 B2 8/2008 Little et al.
7,444,925 B2 11/2008 Mahlich
7,464,518 B2 12/2008 Ansinn
7,543,527 B2 6/2009 Schmed
7,552,672 B2 6/2009 Schmed
7,595,870 B2 9/2009 Ringlien
7,673,558 B2 3/2010 Panesar et al.
7,685,930 B2 3/2010 Mandralis et al.
7,712,258 B2 5/2010 Ewing et al.
7,743,557 B2 6/2010 Liao
7,779,578 B2 8/2010 Gray
7,815,953 B2 10/2010 Mastropasqua et al.
7,935,646 B2 5/2011 Viazmensky et al.
7,946,217 B2 5/2011 Favre et al.
7,981,451 B2 7/2011 Ozanne
8,039,029 B2 10/2011 Ozanne
8,039,034 B2 10/2011 Ozanne
8,088,423 B2 1/2012 Ohresser et al.
8,109,200 B2 2/2012 Hansen
8,114,461 B2 2/2012 Perlman et al.
8,163,318 B2 4/2012 Ozanne et al.
8,168,908 B2 5/2012 Heimann
8,257,766 B2 9/2012 Yoakim et al.
8,276,639 B2 10/2012 Binacchi
8,361,527 B2 1/2013 Winkler et al.
8,443,549 B2 5/2013 Salvietti et al.
8,474,368 B2 7/2013 Kilber et al.
8,491,948 B2 7/2013 Ozanne et al.
8,505,440 B2 8/2013 Kirschner et al.
8,512,886 B2 8/2013 Ozanne
8,579,006 B2 11/2013 Levin
8,734,881 B2 5/2014 Yoakim et al.
8,747,775 B2 6/2014 Sandvick
8,794,125 B1 8/2014 Rivera
8,906,436 B2 12/2014 Nowak
8,916,220 B2 12/2014 Mahlich et al.
8,956,672 B2 2/2015 Yoakim et al.
9,049,958 B2 6/2015 Fischer
9,072,402 B2 7/2015 Ryser
9,079,705 B2 7/2015 Digiuni
9,145,730 B1 9/2015 Santamaria
9,150,347 B2 10/2015 Scheiber
9,204,751 B2 12/2015 Peterson
9,216,854 B2 12/2015 Schreiber
9,271,602 B2 3/2016 Beaulieu et al.
9,277,837 B2 3/2016 Yoakim et al.
9,290,317 B2 3/2016 Quinn et al.
9,295,278 B2 3/2016 Nowak
9,357,791 B2 6/2016 Fountain et al.
9,359,126 B2 6/2016 Wong et al.
9,359,128 B2 6/2016 Mahlich
9,392,902 B2 7/2016 Parentes et al.
9,394,101 B2 7/2016 Empl
9,409,703 B2 8/2016 Krüger et al.
9,409,704 B2 8/2016 Digiuni et al.
9,415,931 B2 8/2016 Gerbaulet et al.
9,428,328 B2 8/2016 Trombetta et al.
9,428,329 B2 8/2016 Trombetta et al.
9,434,525 B2 9/2016 Fabozzi et al.
9,486,108 B1 11/2016 Douglas et al.
9,808,112 B2 11/2017 Favero et al.
2001/0038204 A1 11/2001 Nojima et al.

(56) References Cited

U.S. PATENT DOCUMENTS

2001/0047724 A1 12/2001 Lazaris
2001/0048957 A1 12/2001 Lazaris et al.
2002/0020659 A1 2/2002 Sweeney
2002/0048621 A1 4/2002 Boyd et al.
2002/0088807 A1 7/2002 Perkovic et al.
2002/0104373 A1 8/2002 Ishihara et al.
2002/0110626 A1 8/2002 Buckingham et al.
2003/0005826 A1 1/2003 Sargent et al.
2003/0033938 A1 2/2003 Halliday et al.
2003/0039731 A1 2/2003 Dalton et al.
2003/0121979 A1 7/2003 Haens et al.
2003/0172813 A1 9/2003 Schifferle
2003/0222089 A1 12/2003 Hale
2004/0045443 A1 3/2004 Lazaris et al.
2004/0089158 A1 5/2004 Mahlich
2004/0089602 A1 5/2004 Heinrich et al.
2004/0115310 A1 6/2004 Yoakim et al.
2004/0118295 A1 6/2004 Angeles
2004/0142070 A1 7/2004 Haen
2004/0182250 A1 9/2004 Halliday et al.
2005/0000164 A1 1/2005 Jacobs
2005/0016383 A1 1/2005 Kirschner et al.
2005/0045566 A1 3/2005 Larkin et al.
2005/0051478 A1 3/2005 Karanikos et al.
2005/0061478 A1 3/2005 Huang
2005/0150391 A1 7/2005 Schifferle
2005/0160919 A1 7/2005 Balkau
2005/0183581 A1 8/2005 Kirschner et al.
2005/0235571 A1 10/2005 Ewing et al.
2005/0266122 A1 12/2005 Franceschi
2006/0084344 A1 4/2006 Bonneh
2006/0107841 A1 5/2006 Schifferle
2006/0194004 A1 8/2006 Niemoller et al.
2006/0228447 A1 10/2006 Ganesan et al.
2006/0236871 A1 10/2006 Ternite et al.
2007/0148290 A1 6/2007 Ternite et al.
2007/0157821 A1 7/2007 Panesar et al.
2007/0181005 A1 8/2007 Kirschner et al.
2007/0181412 A1 8/2007 Raunig
2007/0203587 A1 8/2007 Erlandsson et al.
2007/0257118 A1 11/2007 Riley et al.
2007/0283640 A1 12/2007 Shivak et al.
2008/0024536 A1 1/2008 Ternite et al.
2008/0028946 A1 2/2008 Kirschner et al.
2008/0038441 A1 2/2008 Kirschner
2008/0050488 A1 2/2008 Koeling et al.
2008/0085356 A1 4/2008 Colliver et al.
2008/0148948 A1 6/2008 Evers et al.
2008/0187638 A1 8/2008 Hansen
2008/0245236 A1 10/2008 Ternite et al.
2008/0299262 A1 12/2008 Reati
2008/0302251 A1 12/2008 Rijskamp et al.
2009/0004343 A1 1/2009 Xiong et al.
2009/0007793 A1 1/2009 Glucksman et al.
2009/0007796 A1 1/2009 Ricotti
2009/0092711 A1 4/2009 Ninh et al.
2009/0126577 A1 5/2009 Ternite
2009/0136626 A1 5/2009 Mueller
2009/0211458 A1 8/2009 Denisart et al.
2009/0211713 A1 8/2009 Binacchi
2009/0289121 A1 11/2009 Maeda et al.
2009/0291379 A1 11/2009 Oota et al.
2009/0324788 A1 12/2009 Roy et al.
2009/0324791 A1 12/2009 Ohresser et al.
2010/0000667 A1 1/2010 Funnell
2010/0028495 A1 2/2010 Novak et al.
2010/0050880 A1 3/2010 Suter et al.
2010/0051532 A1 3/2010 Wawrla et al.
2010/0054532 A1 3/2010 Mitte et al.
2010/0078480 A1 4/2010 Aker
2010/0108541 A1 5/2010 Degli Esposti Venturi
2010/0132564 A1 6/2010 Ozanne et al.
2010/0181378 A1 7/2010 Hayakawa et al.
2010/0196545 A1 8/2010 Buffet et al.
2010/0239717 A1 9/2010 Yoakim et al.
2010/0239733 A1 9/2010 Yoakim et al.
2010/0239734 A1 9/2010 Yoakim et al.
2010/0260915 A1 10/2010 Young
2010/0263329 A1 10/2010 Nash
2010/0288131 A1 11/2010 Kilber et al.
2010/0288133 A1 11/2010 Litzka et al.
2010/0303964 A1 12/2010 Beaulieu et al.
2010/0308397 A1 12/2010 Ariyoshi
2011/0005399 A1 1/2011 Epars et al.
2011/0020500 A1 1/2011 Eichler et al.
2011/0033580 A1 2/2011 Biesheuvel et al.
2011/0041702 A1 2/2011 Yoakim
2011/0064852 A1 3/2011 Mann
2011/0076361 A1 3/2011 Peterson et al.
2011/0097450 A1 4/2011 Krüger
2011/0142996 A1 6/2011 Krüger
2011/0189350 A1 8/2011 Van Belleghem et al.
2011/0212225 A1 9/2011 Mariller
2011/0250333 A1 10/2011 Ozanne
2011/0250812 A1 10/2011 Pourdeyhimi et al.
2011/0303095 A1 12/2011 Fu et al.
2012/0006685 A1 1/2012 Van Engelen
2012/0058226 A1 3/2012 Winkler et al.
2012/0060697 A1 3/2012 Ozanne
2012/0070542 A1 3/2012 Camera et al.
2012/0070543 A1 3/2012 Mahlich
2012/0070551 A1 3/2012 Mahlich
2012/0097041 A1 4/2012 Bucher et al.
2012/0097602 A1 4/2012 Tedford
2012/0100264 A1 4/2012 Bucher et al.
2012/0109186 A1 5/2012 Parrott et al.
2012/0121765 A1 5/2012 Kamerbeek et al.
2012/0123106 A1 5/2012 Joos
2012/0126834 A1 5/2012 Kleinhans
2012/0183657 A1 7/2012 Marina et al.
2012/0195155 A1 8/2012 Gennai et al.
2012/0201933 A1 8/2012 Dran et al.
2012/0207893 A1 8/2012 Krüger
2012/0207895 A1 8/2012 Rivera
2012/0251668 A1 10/2012 Wong et al.
2012/0251672 A1 10/2012 Kamerbeek et al.
2012/0258210 A1 10/2012 Wong et al.
2012/0295234 A1 11/2012 Rognon et al.
2012/0308688 A1 12/2012 Peterson et al.
2013/0055903 A1 3/2013 Deuber
2013/0059039 A1 3/2013 Trombetta et al.
2013/0064929 A1 3/2013 Jarisch et al.
2013/0064937 A1 3/2013 Jarisch et al.
2013/0084363 A1 4/2013 Krüger et al.
2013/0084376 A1 4/2013 Fischer et al.
2013/0087051 A1 4/2013 Frydman
2013/0101716 A1 4/2013 Beaulieu et al.
2013/0122153 A1 5/2013 Ferrier et al.
2013/0125762 A1 5/2013 Dogan et al.
2013/0129872 A1 5/2013 Krüger et al.
2013/0136828 A1 5/2013 Anghileri
2013/0149424 A1 6/2013 Fischer
2013/0156897 A1 6/2013 Goldstein
2013/0206011 A1 8/2013 Ozanne et al.
2013/0209618 A1 8/2013 Trombetta et al.
2013/0209619 A1 8/2013 Mahlich
2013/0209620 A1 8/2013 Ozanne et al.
2013/0209622 A1 8/2013 Fountain et al.
2013/0216663 A1 8/2013 Dogan et al.
2013/0224343 A1 8/2013 Tremblay
2013/0230627 A1 9/2013 Hansen et al.
2013/0243910 A1 9/2013 Krüger
2013/0312619 A1 11/2013 Spiegel et al.
2014/0001563 A1 1/2014 Krüger et al.
2014/0004231 A1 1/2014 Norton et al.
2014/0017359 A1 1/2014 Krüger et al.
2014/0127364 A1 5/2014 Fu et al.
2014/0141128 A1 5/2014 Trombetta et al.
2014/0141129 A1 5/2014 Greene
2014/0161936 A1 6/2014 Trombetta et al.
2014/0178538 A1 6/2014 Husband et al.
2014/0196608 A1 7/2014 Amrein et al.
2014/0220191 A1 8/2014 Kelly et al.
2014/0224130 A1 8/2014 Castellani et al.

(56) References Cited

U.S. PATENT DOCUMENTS

| | | | |
|---|---|---|---|
| 2014/0230370 | A1 | 8/2014 | Bianchi |
| 2014/0263033 | A1 | 9/2014 | Fu et al. |
| 2014/0272018 | A1 | 9/2014 | Koller et al. |
| 2014/0287104 | A1 | 9/2014 | Austin et al. |
| 2014/0287105 | A1 | 9/2014 | Husband et al. |
| 2014/0346022 | A1 | 11/2014 | Keller et al. |
| 2014/0348984 | A1 | 11/2014 | Zeller et al. |
| 2014/0370181 | A1 | 12/2014 | Young et al. |
| 2015/0010680 | A9 | 1/2015 | Mahlich |
| 2015/0020481 | A1 | 1/2015 | Hodler |
| 2015/0029702 | A1 | 1/2015 | Foley |
| 2015/0056331 | A1 | 2/2015 | Rivera |
| 2015/0056340 | A1 | 2/2015 | Trombetta et al. |
| 2015/0056351 | A1 | 2/2015 | Deuber |
| 2015/0079241 | A1 | 3/2015 | Mahlich |
| 2015/0119220 | A1 | 4/2015 | Rea et al. |
| 2015/0128525 | A1 | 5/2015 | Bartoli et al. |
| 2015/0132441 | A1 | 5/2015 | Accursi |
| 2015/0157164 | A1 | 6/2015 | Digiuni |
| 2015/0158665 | A1 | 6/2015 | Krüger et al. |
| 2015/0158666 | A1 | 6/2015 | Krüger et al. |
| 2015/0166204 | A1 | 6/2015 | Rea et al. |
| 2015/0173558 | A1 | 6/2015 | Cross et al. |
| 2015/0175347 | A1 | 6/2015 | Empl |
| 2015/0201790 | A1 | 7/2015 | Smith et al. |
| 2015/0239652 | A1 | 8/2015 | Trombetta et al. |
| 2015/0246741 | A1 | 9/2015 | Hansen et al. |
| 2015/0274411 | A1 | 10/2015 | Krüger |
| 2015/0297021 | A1 | 10/2015 | Bugnano et al. |
| 2015/0297023 | A1 | 10/2015 | Hansen et al. |
| 2015/0314954 | A1 | 11/2015 | Empl |
| 2015/0329282 | A1 | 11/2015 | Bartoli et al. |
| 2015/0353275 | A1 | 12/2015 | Accursi |
| 2015/0375926 | A1 | 12/2015 | Fischer |
| 2016/0001968 | A1 | 1/2016 | Krüger et al. |
| 2016/0037961 | A1 | 2/2016 | Digiuni |
| 2016/0045060 | A1 | 2/2016 | Flick |
| 2016/0058234 | A1 | 3/2016 | Eppler et al. |
| 2016/0066591 | A1 | 3/2016 | Halliday et al. |
| 2016/0075506 | A1 | 3/2016 | Chapman et al. |
| 2016/0194146 | A1 | 7/2016 | Schelch et al. |
| 2016/0207696 | A9 | 7/2016 | Trombetta et al. |
| 2016/0242594 | A1 | 8/2016 | Empl et al. |
| 2016/0251150 | A1 | 9/2016 | Macchi et al. |
| 2016/0325921 | A1 | 11/2016 | Empl |
| 2016/0332759 | A1 | 11/2016 | Trombetta et al. |
| 2016/0340110 | A1 | 11/2016 | Trombetta et al. |
| 2017/0020329 | A1 | 1/2017 | Douglas et al. |
| 2017/0027374 | A1 | 2/2017 | Smith et al. |

FOREIGN PATENT DOCUMENTS

| | | | |
|---|---|---|---|
| CA | 2327021 | C | 1/2005 |
| CA | 2400033 | C | 2/2005 |
| CA | 2399290 | C | 1/2006 |
| CA | 2399283 | C | 5/2007 |
| CA | 2661921 | A1 | 3/2008 |
| CA | 2763746 | A1 | 3/2010 |
| CA | 2784752 | C | 6/2011 |
| CA | 2662071 | C | 7/2011 |
| CA | 2538256 | C | 8/2011 |
| CA | 2810237 | A1 | 3/2012 |
| CA | 2531544 | C | 5/2012 |
| CA | 2839293 | A1 | 12/2012 |
| CA | 2662069 | C | 1/2013 |
| CA | 2785843 | A1 | 2/2013 |
| CA | 2788283 | A1 | 3/2013 |
| CA | 2850010 | A1 | 5/2013 |
| CA | 2810236 | C | 7/2013 |
| CA | 2866119 | A1 | 9/2013 |
| CA | 2872667 | A1 | 11/2013 |
| CA | 2874025 | A1 | 12/2013 |
| CA | 2874070 | A1 | 12/2013 |
| CA | 2877027 | A1 | 12/2013 |
| CA | 2877090 | A1 | 1/2014 |
| CA | 2886299 | A1 | 4/2014 |
| CA | 2888129 | A1 | 4/2014 |
| CA | 2888658 | C | 6/2014 |
| CA | 2898173 | A1 | 8/2014 |
| CA | 2902231 | A1 | 8/2014 |
| CA | 2905188 | A1 | 9/2014 |
| CA | 2901582 | A1 | 11/2014 |
| CA | 2901664 | A1 | 11/2014 |
| CA | 2922822 | A1 | 2/2015 |
| CA | 2922824 | A1 | 2/2015 |
| CA | 2832794 | C | 3/2016 |
| CA | 2833096 | C | 5/2016 |
| CN | 101014513 | A | 8/2007 |
| CN | 101090657 | A | 12/2007 |
| CN | 101646613 | A | 2/2010 |
| CN | 101828840 | A | 9/2010 |
| CN | 102791595 | A | 11/2012 |
| CN | 102958816 | A | 3/2013 |
| CN | 103501624 | A | 1/2014 |
| DE | 1207866 | B | 12/1965 |
| DE | 1221960 | B | 7/1966 |
| DE | 69615001 | T2 | 3/2002 |
| DE | 102004056224 | A1 | 5/2006 |
| DE | 202006003115 | U1 | 5/2006 |
| DE | 102006004329 | A1 | 8/2007 |
| DE | 202009014945 | U1 | 9/2010 |
| DE | 202010007919 | U1 | 11/2010 |
| DE | 102010027485 | A1 | 1/2012 |
| DE | 102010034206 | A1 | 2/2012 |
| DE | 102011012881 | A1 | 3/2012 |
| DE | 102011010534 | A1 | 8/2012 |
| DE | 102011115833 | A1 | 4/2013 |
| DE | 102012105282 | A1 | 12/2013 |
| DE | 102012110446 | A1 | 1/2014 |
| DE | 102012109186 | A1 | 3/2014 |
| DE | 102014018470 | A1 | 6/2016 |
| EP | 0224297 | A1 | 6/1987 |
| EP | 0244339 | A1 | 11/1987 |
| EP | 0468078 | A1 | 1/1992 |
| EP | 0468079 | A1 | 1/1992 |
| EP | 0656224 | A1 | 6/1995 |
| EP | 0859467 | A1 | 8/1998 |
| EP | 0923865 | A2 | 6/1999 |
| EP | 1129623 | A1 | 9/2001 |
| EP | 1221418 | A1 | 7/2002 |
| EP | 1263661 | A1 | 12/2002 |
| EP | 1344722 | A1 | 9/2003 |
| EP | 1344724 | A1 | 9/2003 |
| EP | 1363501 | A2 | 11/2003 |
| EP | 1471012 | A2 | 10/2004 |
| EP | 1500358 | A1 | 1/2005 |
| EP | 1555219 | A1 | 7/2005 |
| EP | 1559351 | A2 | 8/2005 |
| EP | 1586534 | A1 | 10/2005 |
| EP | 1710173 | A1 | 10/2006 |
| EP | 1792850 | A1 | 6/2007 |
| EP | 1792850 | B1 | 6/2007 |
| EP | 1796516 | A2 | 6/2007 |
| EP | 1849718 | A1 | 10/2007 |
| EP | 1882432 | B1 | 1/2008 |
| EP | 1892199 | A1 | 2/2008 |
| EP | 1974638 | A1 | 10/2008 |
| EP | 2158829 | A1 | 3/2010 |
| EP | 1882431 | B1 | 4/2010 |
| EP | 2218653 | A1 | 8/2010 |
| EP | 2230195 | A1 | 9/2010 |
| EP | 2239211 | A1 | 10/2010 |
| EP | 2284102 | A1 | 2/2011 |
| EP | 2287090 | A1 | 2/2011 |
| EP | 2345352 | A1 | 7/2011 |
| EP | 2364930 | A2 | 9/2011 |
| EP | 2384133 | B1 | 11/2011 |
| EP | 2384996 | A1 | 11/2011 |
| EP | 2412645 | A1 | 2/2012 |
| EP | 2412646 | A1 | 2/2012 |
| EP | 2444339 | A1 | 4/2012 |
| EP | 2476633 | A1 | 7/2012 |
| EP | 2484505 | A2 | 8/2012 |
| EP | 25100805 | A2 | 10/2012 |

(56) References Cited

FOREIGN PATENT DOCUMENTS

| | | | |
|---|---|---|---|
| EP | 2537778 | A1 | 12/2012 |
| EP | 2559636 | A1 | 2/2013 |
| EP | 2647317 | A1 | 10/2013 |
| EP | 2720961 | A1 | 4/2014 |
| EP | 2750876 | A1 | 7/2014 |
| EP | 2752372 | A1 | 7/2014 |
| EP | 2809006 | A1 | 12/2014 |
| EP | 2909088 | A1 | 8/2015 |
| EP | 2971319 | A1 | 1/2016 |
| EP | 2996522 | A1 | 3/2016 |
| FR | 2556323 | A1 | 6/1985 |
| FR | 2912124 | A1 | 8/2008 |
| FR | 2963332 | A1 | 2/2012 |
| GB | 1402799 | A | 8/1975 |
| GB | 2482032 | A | 1/2012 |
| GB | 2489409 | A | 10/2012 |
| JP | S62-130649 | A | 6/1987 |
| JP | S62-168512 | A | 7/1987 |
| JP | H01-233688 | A | 9/1989 |
| JP | 02289207 | A | 11/1990 |
| JP | H0394377 | A | 4/1991 |
| JP | H04176311 | A | 6/1992 |
| JP | 2001-017094 | A | 1/2001 |
| JP | 2001-082699 | A | 3/2001 |
| JP | 2002-274000 | A | 9/2002 |
| JP | 2002-347852 | A | 12/2002 |
| JP | 2003-265320 | A | 9/2003 |
| JP | 2004-097015 | A | 4/2004 |
| JP | 2004-533305 | A | 11/2004 |
| JP | 2007-522856 | A | 8/2007 |
| JP | 2009-511143 | A | 3/2009 |
| JP | 2010-500199 | A | 1/2010 |
| JP | 2010-516364 | A | 5/2010 |
| JP | 2011-530321 | A | 12/2011 |
| JP | 2015-085086 | A | 5/2015 |
| KR | 1020050107747 | A | 11/2005 |
| NZ | 596919 | A | 11/2013 |
| WO | 98/51396 | A1 | 11/1998 |
| WO | 99/58035 | A1 | 11/1999 |
| WO | 2001/60712 | A1 | 8/2001 |
| WO | 02/078498 | A1 | 10/2002 |
| WO | 2004/082390 | A1 | 9/2004 |
| WO | 2005/044067 | A1 | 5/2005 |
| WO | 2005/079638 | A1 | 9/2005 |
| WO | 2006/014936 | A2 | 2/2006 |
| WO | 2006/021405 | A2 | 3/2006 |
| WO | 2006/053635 | A1 | 5/2006 |
| WO | 2006/121520 | A2 | 11/2006 |
| WO | 2007/042414 | A1 | 4/2007 |
| WO | 2007/042486 | A2 | 4/2007 |
| WO | 2008/011913 | A1 | 1/2008 |
| WO | 2008/090122 | A2 | 7/2008 |
| WO | 2008/107645 | A2 | 9/2008 |
| WO | 2008/121489 | A1 | 10/2008 |
| WO | 2008/126045 | A1 | 10/2008 |
| WO | 2008/0132571 | A1 | 11/2008 |
| WO | 2009/084061 | A1 | 7/2009 |
| WO | 2009/114119 | A1 | 9/2009 |
| WO | 2009/115475 | A1 | 9/2009 |
| WO | 2009/130311 | A1 | 10/2009 |
| WO | 2009/153161 | A1 | 12/2009 |
| WO | 2010/007633 | A1 | 1/2010 |
| WO | 2010/013146 | A3 | 4/2010 |
| WO | 2010041179 | A2 | 4/2010 |
| WO | 2010/085824 | A1 | 8/2010 |
| WO | 2010/118545 | A2 | 10/2010 |
| WO | 2010/138563 | A1 | 11/2010 |
| WO | 2010/137952 | A1 | 12/2010 |
| WO | 2010/137960 | A1 | 12/2010 |
| WO | 2011/012501 | A1 | 2/2011 |
| WO | 2011/089049 | A1 | 7/2011 |
| WO | 2011137550 | A1 | 11/2011 |
| WO | 2011/147491 | A1 | 12/2011 |
| WO | 2011/147553 | A1 | 12/2011 |
| WO | 2011/147591 | A1 | 12/2011 |
| WO | 2012/007257 | A1 | 1/2012 |
| WO | 2012/009668 | A1 | 1/2012 |
| WO | 2012/010317 | A1 | 1/2012 |
| WO | 2012/019902 | A1 | 2/2012 |
| WO | 2012/038063 | A1 | 3/2012 |
| WO | 2012/080501 | A1 | 6/2012 |
| WO | 2012/080928 | A1 | 6/2012 |
| WO | 2012/100977 | A1 | 8/2012 |
| WO | 2012/104760 | A1 | 8/2012 |
| WO | 2012/123106 | A1 | 9/2012 |
| WO | 2012/127233 | A2 | 9/2012 |
| WO | 2012/135204 | A1 | 10/2012 |
| WO | 2012/174331 | A1 | 12/2012 |
| WO | 2012/175985 | A1 | 12/2012 |
| WO | 2013/008012 | A2 | 1/2013 |
| WO | 2013/029184 | A1 | 3/2013 |
| WO | 2013/032330 | A1 | 3/2013 |
| WO | 2013/043048 | A1 | 3/2013 |
| WO | 2013/053757 | A1 | 4/2013 |
| WO | 2013/064988 | A1 | 5/2013 |
| WO | 2013/136209 | A1 | 9/2013 |
| WO | 2013/149354 | A2 | 10/2013 |
| WO | 2013/171663 | A1 | 11/2013 |
| WO | 2013/189555 | A1 | 12/2013 |
| WO | 2013/189923 | A1 | 12/2013 |
| WO | 2014/001563 | A1 | 1/2014 |
| WO | 2014/001564 | A1 | 1/2014 |
| WO | 2014/006048 | A2 | 1/2014 |
| WO | 2014/049143 | A2 | 4/2014 |
| WO | 2014/090567 | A1 | 6/2014 |
| WO | 2014/102702 | A1 | 7/2014 |
| WO | 2014/127863 | A1 | 8/2014 |
| WO | 2014/128205 | A1 | 8/2014 |
| WO | 2014/131779 | A1 | 9/2014 |
| WO | 2012/000878 | A2 | 1/2015 |
| WO | 2015/028425 | A2 | 3/2015 |
| WO | 2015/062703 | A1 | 5/2015 |
| WO | 2015/075584 | A1 | 5/2015 |
| WO | 2015/107484 | A1 | 7/2015 |
| WO | 2016/077916 | A1 | 5/2016 |

OTHER PUBLICATIONS

International Search Report for International Application No. PCT/EP2016/053684, dated Mar. 30, 2016 X.

International Preliminary Report on Patentability for International Application No. PCT/EP2016/053684, dated Jan. 31, 2017.

Notification of Reason for Refusal for Korean Application No. 10-2017-7027172, dated Aug. 14, 2018.

First Office Action for Chinese Application No. 201680011536.0; dated Sep. 26, 2018.

* cited by examiner

SINGLE SERVE CAPSULE COMPRISING A FILTER ELEMENT CONNECTED THERETO BY SEALING

PRIOR ART

The present invention relates to a single-serve capsule for producing a beverage, having a side wall and a base which together define a space, wherein, within the space, a filter element is sealed to the base.

Such single-serve capsules are known from the prior art and are used for example to produce coffee or tea or coffee-like beverages such as espresso. For example, the documents EP 1 792 850 b1, EP 1 344 722 A1 and US 2003/0172813 A1 disclose single-serve capsules for preparing coffee and espresso. The single-serve capsules are preferably shaped in a frustoconical or cylindrical manner and are produced for example from a thermoformed plastic film or by a plastic injection-molding process. They usually have a side wall with an encircling flange, an open filling side for a beverage substrate to be extracted and/or dissolved for beverage production, and a capsule base, wherein a filter element that is supported on the capsule base is arranged between the beverage substrate and the capsule base. After the filter element has been introduced and sealed to the single-serve capsule base and the beverage substrate has been introduced, the single-serve capsule is closed with a cover film, which is, for example, sealed or adhesively bonded to the flange. In order to prepare a coffee beverage, the single-serve capsule is introduced into a brewing chamber of a preparation appliance. Before, after or during the introduction of the single-serve capsule into the brewing chamber, the single-serve capsule is preferably opened on its base side, and after the brewing chamber has been sealed off, the filling side, closed off by a closure film, of the single-serve capsule is perforated by means of a piercing means. Subsequently, preparation liquid, preferably hot water, is delivered under pressure into the single-serve capsule. The preparation liquid flows through the beverage substrate and extracts and/or dissolves the substances required for beverage production from the beverage substrate. In order to prepare an espresso, a brewing water pressure of up to 20 bar for example acts on the coffee powder in order to extract the essential oils.

The document DE 10 2012 109 185 A1 furthermore discloses single-serve capsule which has a filter element that is sealed to the base of the single-serve capsule with the aid of an annular sealing seam, wherein the inside diameter of the sealing seam is 67-77% of the diameter of the filter element and the outside diameter of the sealing seam is 84-94% of the diameter of the filter element, in order to reduce foam formation at the surface of the produced beverage.

A drawback of this solution is that the sealing seam is located comparatively close to the outer periphery of the filter element and thus precise positioning of the filter element relative to the sealing tool is necessary during the production of the single-serve capsule.

DISCLOSURE OF THE INVENTION

Therefore, it was the object of the present invention to provide a single-serve capsule which does not have the drawbacks of the prior art and is in particular easier and more cost-effective to produce.

The object is achieved by a single-serve capsule for producing a beverage, having a side wall and a base which together define a space, wherein, within the space, a filter element is sealed to the base or to a carrier element by a substantially annular sealing seam, wherein the filter element comprises a nonwoven and wherein the outside diameter of the sealing seam is 55 to 75 percent of the diameter of the filter element.

Compared with the prior art, the single-serve capsule according to the invention has the advantage that the outside diameter of the sealing seam is at a relatively large distance from the outer periphery of the filter element, such that precise positioning of the filter element relative to the sealing tool is not necessary during the production of the single-serve capsule. At the same time, it has surprisingly been found that the associated reduction in the active filter area available in the center of the nonwoven-based filter element does not result in any impairment of the production of the beverage. The single-serve capsule according to the invention is thus easier and more cost-effective to produce compared with single-serve capsules known from the prior art, without the beverage quality deteriorating. Preferably, the outside diameter of the sealing seam is 60 to 70 percent of the diameter of the filter element. The single-serve capsule is filled in particular with beverage raw material, for example instant coffee powder, ground roasted coffee beans blended tea leaves, cocoa powder, milk powder and/or the like. It would also be conceivable for the filter element not to be sealed directly to the base of the single-serve capsule but to a carrier element arranged in the interior of the single-serve capsule. The carrier element serves to carry the filter element and either preferably rests on the base or is spaced apart from the base. The carrier element can be for example a rigid plastic injection-molding.

The filter element is provided in a disk-like manner and preferably has a circular cross section, Within the meaning of the present invention the diameter of the filter element includes in particular the maximum or mean diameter of this cross section of the filter element. The sealing seam which connects the filter element to the base of the single-serve capsule in a materially bonded manner is preferably attached by ultrasonic welding. Preferably, the filter element is liquid impermeable in the region of the sealing seam following sealing.

The inside diameter of the sealing seam is preferably 45 to 65 percent and preferably 50 to 60 percent of the diameter of the filter element. It has been shown that, with such an inside diameter of the sealing seam, a sufficiently large active filter area is still available in the center of the filter element, in order to rapidly create a high-quality beverage with the single-serve capsule. The width of the sealing seam is then preferably 1 to 1.5 millimeters.

In absolute terms, the diameter of the filter element is preferably between 24 and 36 millimeters and particularly preferably between 29 and 31 millimeters.

The filter element, or nonwoven material, preferably comprises an area density (also referred to as grammage or surface weight) of between 50 and 500 grams per square meter, particularly preferably between 75 and 250 grams per square meter, and very particularly preferably substantially 100 grams per square meter for single-serve capsules for producing tea, coffee, espresso or the like.

Preferably, the surface of the nonwoven material is treated, preferably heat-treated, in order for example to fix loose fibers. The heat treatment preferably takes place only on a side of the filter element that faces away from the beverage raw material, in order to knot or bind the fibers such that the fibers do not pass into the beverage. On the other side of the filter element, i.e. on the side facing the beverage raw material, the filter element is preferably calendered, particularly preferably spot calendered. In this way, the volume of the nonwoven material is reduced and so more space for the beverage raw material is available within the single-serve capsule. However, it Id also be conceivable for the filter element to be heat-treated on both sides.

A further subject of the present invention is a single-serve capsule for producing a beverage, having a side wall and a base which together define a space, wherein, within the space, a filter element is sealed to the base or to a carrier element by a substantially annular sealing seam, wherein the filter element comprises a felt and, wherein the outside diameter of the sealing seam is 75 to 85 percent of the maximum diameter of the filter element.

Compared with the prior art, the single-serve capsule according to the invention—similarly to the above-described single-serve capsule—again has the advantage that it is easier and more cost-effective to produce. However, it has been shown that when a filter element based on felt material is used, the outside diameter of the sealing seam has to be selected to be somewhat larger than in the case of a filter element based on nonwoven material, in order that the quality of the produced beverage is not impaired. In addition, with this diameter, very little foam formation is furthermore advantageously achieved on the produced beverage. Preferably, the outside diameter of the sealing seam for this purpose is 80±2 percent of the maximum diameter of the filter element.

The inside diameter of the sealing seam is preferably 66 to 76 percent and particularly preferably 71±2 percent of the maximum diameter of the filter element.

The cross section of the filter element based on felt material preferably has the form of a polygon and in particular of a hexagon. Within the meaning of the present invention, the maximum diameter is measured at the corners of the polygon. The maximum diameter of the filter element is preferably between 26 and 37 millimeters and particularly preferably between 31 and 32 millimeters in the region of the corners of the polygon. The minimum diameter of the filter element is preferably between 23 and 35 millimeters and particularly preferably between 28 and 30 millimeters in the region of the edges of the polygon. Alternatively, however, it would also be conceivable for the filter element based on felt material, like the filter element based on nonwoven material, to be provided with a circular cross section.

Preferably, the filter element has a felt structure. In particular, it is a needle felt structure. Preferably, the filter element consists of at least one felt structure and a carrier structure, in particular a woven structure, wherein, particularly preferably, the felt structure makes up at least a part of the volume of the carrier structure. Preferably, the felt structure extends over the entire cross section of the carrier structure, but particularly preferably only over a subregion of the height. Preferably, the felt structure is connected to the carrier structure in a form-fitting, force-fitting and/or materially bonded manner. Preferably, the filter element has two or more felt structures, which are preferably separated from one another by the carrier structure. The thickness of the two felt structures can be the same or different. Preferably, a felt structure facing the powder or tea is thinner than the felt structure facing the capsule base, or vice versa.

Preferably, the surface of the felt structure is treated, for example heat-treated, in order for example to fix loose fibers. The heat treatment preferably takes place only on a side of the filter element that faces away from the beverage raw material, in order to knot or bind the fibers such that the fibers do not pass into the beverage. On the other side of the filter element, i.e. on the side facing the beverage raw material, the filter element is preferably calendered, particularly preferably spot calendered. In this way, the volume of the felt material is reduced and so more space for the beverage raw material is available within the single-serve capsule. However, it would also be conceivable for the filter element to be heat-treated on both sides.

Preferably, the filter element having a felt structure is merely laid in the capsule, in particular on the base thereof. However, the filter element can also be connected to the capsule, in particular the base thereof, in particular by material bonding. During perforation, the perforation means can penetrate into this filter element. Preferably, several filter elements, which have one or more felt structures and a carver structure, are arranged one above another in the capsule and optionally connected together.

A filter element having a carrier structure, in particular a woven structure, and a felt structure is produced for example in that a woven structure consisting of longitudinal and transverse threads is made available. In order to construct a felt, in particular a needle felt, single fibers of 0.8-7 dtex are preferably selected. The individual fibers are connected together to form a felt and/or anchored in the carrier structure preferably by way of the production process of needling. In this case, needles having reversed barbs pierce the infed fibrous pack, and are retracted therefrom, at high speed. By way of the barbs, the fibers are interlooped with one another and/or with the woven carrier fabric by way of a multiplicity of loops that are created.

The filter element, or the carrier element, having one or more felt structures preferably comprises an area density (also referred to as grammage or surface weight) of between 100 and 1500 grams per square meter, particularly preferably between 650 and 1300 grams per square meter, and very particularly preferably substantially 1150 grams per square meter for single-serve capsules for producing tea, coffee, espresso or the like.

In the embodiment having a filter element based on felt material, the filter element preferably has a thickness of between 0.8 and 3.3 millimeters, particularly preferably between 1.1 and 3.0 millimeters, and very particularly preferably 1.2-1.4 millimeters for the production of tea, and 2.6-3.0 millimeters for the production of coffee. In the embodiment with a filter element based on nonwoven material, the filter element preferably has a thickness of between 0.2 and 0.8 millimeters, particularly preferably between 0.25 and 0.39 millimeters, and very particularly preferably substantially 0.32 millimeters.

The particularly preferred embodiments described in the following text relate both to the single-serve capsule having a filter element based on nonwoven material and to the single-serve capsules having a filter element based on felt material.

In a preferred embodiment, the width of the sealing se m is 1-1.5 millimeters.

Preferably, the base of the single-serve capsule has a substantially flat portion which is formed in a circular manner and the outside diameter of which is 84-94% of the diameter of the filter element. The outer circumference of the flat portion is preferably adjoined by a bead by way of which the flat portion is somewhat spaced apart from a possible support. The bead furthermore forms the transition between the flat base and the side wall and gives the single-serve capsule stability. Preferably, the filter material extends into the region of the bead and at least partially covers the latter without touching it.

According to a preferred embodiment, the base has a clearance which is large enough that, when the beverage flows out of/through, this clearance, substantially no pressure drop occurs. This clearance is preferably already incorporated into the capsule base before the filter element is sealed to the capsule base. The clearance is preferably closed off with a film or the like before the preparation operation, said film being able to be pulled off or perforated by a piercing member.

Preferably, the diameter of the filter element is smaller, in particular 1-5% smaller, than the internal dimension of the single-serve capsule at the base level. However, it would also be conceivable for the diameter of the filter element to be greater than the diameter of the base. The periphery of the filter element is then folded up at the periphery of the base.

Further details, features and advantages of the invention can be gathered from the drawings and from the following description of preferred embodiments with reference to the drawings. In this case, the drawings illustrate merely exemplary embodiments of the invention, which do not limit the essential concept of the invention.

EMBODIMENTS OF THE INVENTION

Figure 1A:
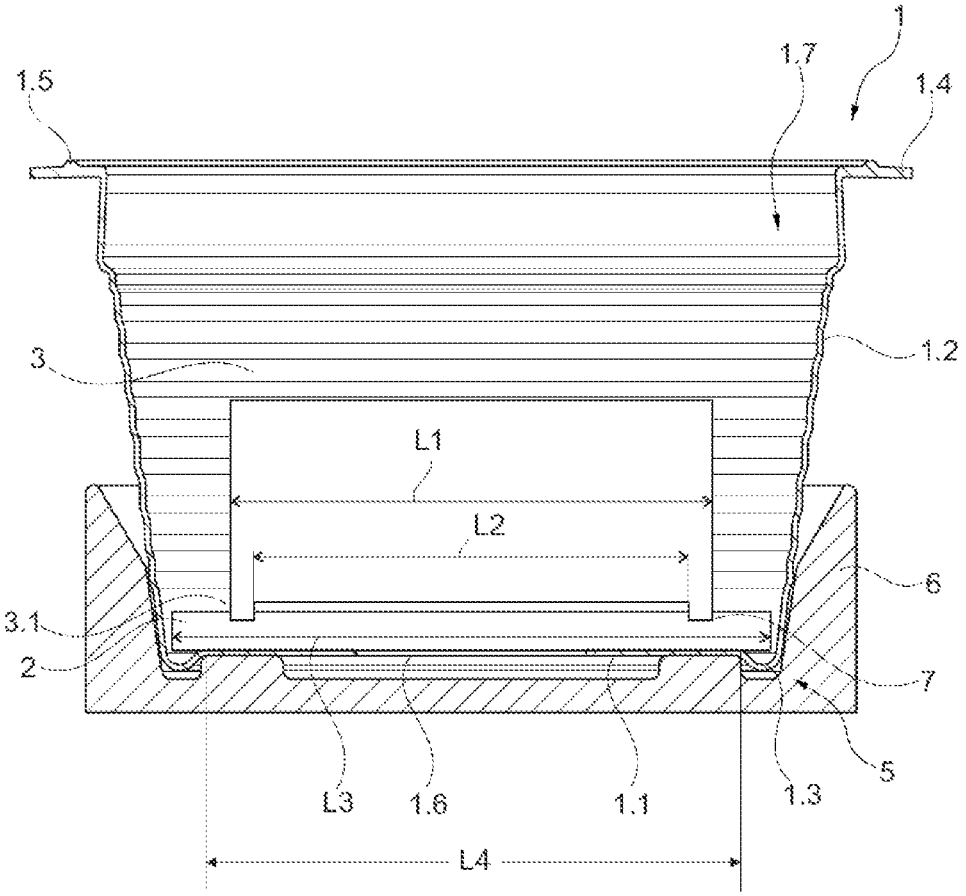
FIG. 1*a* shows a schematic sectional view of a single-serve capsule together with sealing tools according to a first exemplary embodiment of the present invention.
Figure 1B:
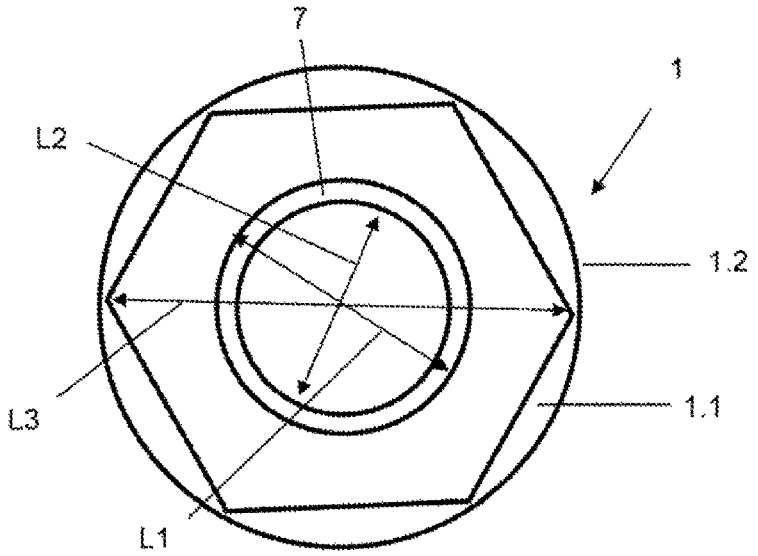
FIG. 1*b* shows a schematic plan view of a single-serve capsule according to the first exemplary embodiment of the present invention.

FIGS. 1*a* and 1*b* schematically illustrate the single-serve capsule 1 according to the invention according to the first embodiment, in FIG. 1*a* together with a sealing tool 3. The single-serve capsule 1 is embodied in a substantially frustoconical manner and has an encircling side wall 1.2 and a base region 1.1. The side wall 1.2 and the base region 1.1 define a space 1.7 in which a filter element 2 is located which, in the present case, has a felt structure. The filter element 2 is sealed to the base 1.1 of the single-serve capsule 1, forming a sealing seam 7, by means of the sealing tool 3, which has sealing surfaces 3.1 at its lower end. In this case, the single-serve capsule 1 is held at least partially in a counterholder 6 of the sealing tool 3. The base 1.1 of the single-serve capsule 1 has a circular flat portion, the outer end of which is adjoined by an annular bead 1.3, which at the same time represents the transition region 5 between the base 1.1 and the side wall 1.2. By way of the bead 1.3, the flat portion of the base 1.1 is spaced apart from a possible support on which the bead stands. Provided in the flat portion is a clearance 1.6, in this case a circular clearance, which is preferably large enough that, when the produced beverage flows out of the single-serve capsule 1, a noticeable pressure drop does not occur and/or that the produced beverage is not swirled. As soon as the filter element 2 has been sealed to the base of the single-serve capsule 1, in particular by ultrasound, and the sealing tool 3 has been removed from the single-serve capsule 1, the latter is filled with a beverage substrate, for example with blended tea or ground coffee and is then closed preferably with a film which is sealed or adhesively bonded to the flange 1.4 which adjoins the side wall in an annular manner. For this purpose, the flange preferably has a protrusion 1.5 which serves as a defined sealing face.

According to the invention, provision is now made for the sealing seam 7 to be provided in an annular manner and for the outside diameter of the sealing seam L2 to be 75-85%, preferably 80±2%, in this case 79%, of the maximum diameter L3 of the filter element 2. As a result of this arrangement of the sealing seam 7, when the beverage is being produced, in particular during the production of coffee, no noticeable foam is produced and the single-serve capsule 1 is comparatively easy and cost-effective to produce. Preferably, the inside diameter L1 of the sealing seam is 66-76%, particularly preferably 71±2%, in this case 71%, of the maximum diameter L3 of the filter element 2. FIG. 1*b* reveals that the cross section of the filter element 2 in the present example is configured in the form of a hexagon with six corners and six edges. The expression "maximum diameter L3 of the filter element 2" is understood here to mean the diameter in the region of the corners. The maximum diameter L3 of the filter element 2 is in particular between 26 and 37 millimeters, preferably between 31 and 32 millimeters, in the region of the corners of the polygon. The minimum diameter of the filter element 2 in the region of the edges of the polygon is in particular between 23 and 35 millimeters and preferably between 28 and 30 millimeters. Alternatively, however, it would also be conceivable for the filter element 2 to have a circular cross section, for example with a diameter between 24 and 36 millimeters and preferably between 29 and 31 millimeters.

Preferably, the width of the sealing seam is 1.5 millimeters, During welding, the filter element 2 is connected to the capsule base 1.1. At the same time, however, the felt structure is also at least partially compressed and fixed preferably in the compressed state. Transverse flows in the felt structure are preferably at least limited in the region of the welding seam 7. The outside diameter of the filter element is furthermore preferably provided to be greater than the outside diameter of the flat portion of the filter base. Preferably, the outside diameter L4 of the flat portion of the capsule base is 84-94%, in this case 90%, of the diameter L3 of the filter element. Consequently, the filter element 2 projects into the region of the bead without touching the bottom of the bead. Furthermore preferably, the outside diameter L3 of the filter element is smaller than the diameter of the single-serve capsule in the region of the base. Preferably, the sealing seam is provided concentrically to the clearance 1.6 in the capsule base.

Figure 2:
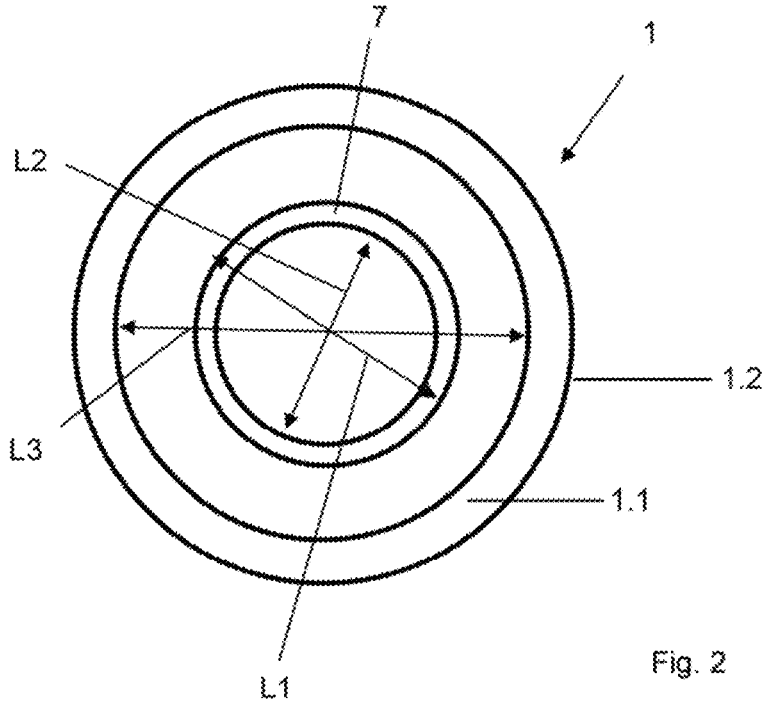
FIG. 2 shows a schematic plan view of a single-serve capsule according to a second exemplary embodiment of the present invention.

FIG. 2 illustrates a single-serve capsule 1 according to a second embodiment of the present invention. The single-serve capsule 1 according to the second embodiment corresponds substantially to the single-serve capsule 1 according to the first embodiment (and therefore reference is made to FIG. 1*a*). The only difference is that the filter element 2 in the single-serve capsule 1 according to the second embodiment is produced from nonwoven and has a circular cross section. In addition, provision is now made according to the invention for the outside diameter of the sealing seam L2 to be 55-75%, preferably 60 to 70%, in this case 67%, of the maximum diameter L3 of the filter element 2 and for the inside diameter L1 of the sealing seam to be 45-65%, particularly preferably 50 to 60%, in this case 58%, of the maximum diameter L3 of the filter element 2.

LIST OF REFERENCE SIGNS

1 Single-serve capsule
1.1 Base region

1.2 Side wall
1.3 Base region/side wall transition, bead
1.4 Flange
1.5 Protrusion on the flange, sealing face
1.6 Clearance
1.7 Space
2 Filter element, felt, nonwoven
3 Sealing tool
3.1 Sealing face
5 Transition region between the base 1.1 and the side wall 1.2
6 Counterholder
7 Sealing seam
L1 Outside diameter of the sealing seam
L2 Inside diameter of the sealing seam
L3 Diameter of the filter element
L4 Diameter of the flat part of the base

The invention claimed is:

1. A single-serve capsule for producing a beverage, having a side wall and a base which together define a space, wherein, within the space, a filter element is sealed to the base or to a carrier element by a substantially annular sealing seam, wherein the filter element comprises a nonwoven material, wherein an outside diameter of the sealing seam is 60 to 70 percent of a diameter of the filter element.

2. The single-serve capsule as claimed in claim 1, wherein an inside diameter of the sealing seam is 45 to 65 percent of the diameter of the filter element.

3. The single-serve capsule as claimed in claim 2, wherein the inside diameter of the sealing seam is 50 to 60 percent of the diameter of the filter element.

4. The single-serve capsule as claimed in claim 1, wherein the diameter of the filter element is between 24 and 36 millimeters.

5. The single serve capsule as claimed in claim 4, wherein the diameter of the filter element is between 29 and 31 millimeters.

6. The single-serve capsule as claimed in claim 1, wherein a width of the sealing seam is 1 to 1.5 millimeters.

7. The single-serve capsule as claimed in claim 1, wherein the base has a substantially flat portion, an outside diameter of which is 84 to 94 percent of the diameter of the filter element.

8. The single-serve capsule as claimed in claim 1, wherein the base has a clearance which is large enough that, when the beverage flows out through the clearance, substantially no pressure drop occurs.

9. The single-serve capsule as claimed in claim 1, wherein the diameter of the filter element is 1 to 5 percent smaller than an internal dimension of the single-serve capsule at the level of the base.

10. The single-serve capsule as claimed in claim 1, wherein the filter element is formed in a multilayer manner.

11. The single-serve capsule as claimed in claim 1, wherein a maximum diameter of the filter element is greater than a diameter of the base.

12. The single-serve capsule as claimed in claim 1, wherein at least one side, facing the space, of the filter element comprising the nonwoven material is calendered.

13. The single serve capsule as claimed in claim 12, wherein at least one side, facing the space, of the filter element comprising the nonwoven material is spot calendered.

14. The single serve capsule as claimed in claim 12, wherein at least one side, facing the space, of the filter element comprising the nonwoven material is heat-treated.

* * * * *